US008371225B2

(12) United States Patent
Bointon et al.

(10) Patent No.: US 8,371,225 B2
(45) **Date of Patent: *Feb. 12, 2013**

(54) DEVICE, METHOD, AND APPARATUS FOR LIFTING A RAILWAY RAIL

(75) Inventors: Richard Bointon, Yealmpton (GB); Jan Anders Svendsen, Tranby (NO)

(73) Assignee: Multiclip Co. Ltd., Surrey (GB)

( * ) Notice: Subject to any disclaimer, the term of this patent is extended or adjusted under 35 U.S.C. 154(b) by 5 days.

This patent is subject to a terminal disclaimer.

(21) Appl. No.: 13/013,048

(22) Filed: Jan. 25, 2011

(65) Prior Publication Data

US 2011/0113980 A1 May 19, 2011

Related U.S. Application Data

(63) Continuation of application No. 11/996,062, filed as application No. PCT/GB2006/002536 on Jul. 7, 2006, now Pat. No. 7,895,949.

(30) Foreign Application Priority Data

Jul. 20, 2005 (GB) ..... 0514907.5

(51) Int. Cl.
*E01B 29/04* (2006.01)
*E01B 29/44* (2006.01)

(52) U.S. Cl. ..... 104/2

(58) Field of Classification Search ..... 104/2, 4, 104/7.1, 7.2, 9, 13, 15, 16, 17.1, 17.2
See application file for complete search history.

(56) References Cited

U.S. PATENT DOCUMENTS

| | | | |
|---|---|---|---|
| 1,663,061 | A | 3/1928 | Rich |
| 1,804,301 | A | 5/1931 | Andrews, Jr. |
| 1,849,178 | A | 3/1932 | Dimetroff |
| 1,925,203 | A | 9/1933 | Quesenberry |
| 2,147,527 | A | 2/1939 | Foreman |
| 2,762,313 | A | 9/1956 | Sublett |
| 3,192,871 | A | 7/1965 | Krause, Jr. |
| 3,461,810 | A | 8/1969 | Yard |
| 3,905,300 | A | 9/1975 | Stewart |
| 4,457,234 | A | 7/1984 | Theurer et al. |

FOREIGN PATENT DOCUMENTS

| | | | |
|---|---|---|---|
| AT | 349049 | T | 1/2007 |
| DE | 1231736 | B | 1/1967 |
| DE | 1708652 | A1 | 5/1975 |
| DE | 2752866 | A1 | 5/1979 |
| DE | 3509719 | A1 | 9/1986 |
| EP | 1424444 | A2 | 6/2004 |
| FR | 1236008 | A | 7/1960 |
| FR | 1440058 | A | 5/1966 |
| FR | 2488577 | A1 | 9/1982 |
| FR | 2562573 | A1 | 10/1985 |
| FR | 2853637 | A1 | 10/2004 |
| FR | 2859489 | A1 | 3/2005 |

(Continued)

OTHER PUBLICATIONS

International Preliminary Report on Patentability from PCT/GB2006/002536, dated Jan. 22, 2008 (7 pages).

(Continued)

*Primary Examiner* — S. Joseph Morano
*Assistant Examiner* — Zachary Kuhfuss
(74) *Attorney, Agent, or Firm* — Marshall, Gerstein & Borun LLP

(57) ABSTRACT

A railway-rail-lifting device for lifting a railway rail comprises an arm and a roller rotatably mounted to the arm. The arm is operable to be rotated to bring the roller to bear on the rail such that the roller exerts a lifting force thereon. Securing means are operable to releasably secure the device to a rail fastening assembly.

16 Claims, 9 Drawing Sheets

FOREIGN PATENT DOCUMENTS

| | | | |
|---|---|---|---|
| GB | 208310 | A | 12/1923 |
| GB | 215378 | A | 8/1924 |
| GB | 202987 | A | 11/1924 |
| GB | 216091 | A | 5/1925 |
| GB | 233469 | A | 5/1925 |
| GB | 921485 | A | 3/1963 |
| GB | 1035743 | A | 7/1966 |
| GB | 1513035 | A | 6/1978 |
| GB | 1591311 | A | 6/1981 |
| SU | 10269 | | 6/1929 |
| SU | 181680 | | 4/1965 |
| WO | WO-0196663 | A1 | 12/2001 |

OTHER PUBLICATIONS

International Searh Report dated Feb. 12, 2009 (1 page).

U.K. Search Report from GB 0514907.5 (3 pages).

DEVICE, METHOD, AND APPARATUS FOR LIFTING A RAILWAY RAIL

RELATED APPLICATIONS

This application is a continuation of U.S. patent application Ser. No. 11/996,062, filed Apr. 2, 2008, which is a U.S. National Phase of International Patent Application No. PCT/GB2006/002536, filed Jul. 7, 2006, which claims priority to GB 0514907.5, filed Jul. 20, 2005. Each of U.S. patent application Ser. No. 11/996,062, PCT/GB2006/002536, and GB 0514907.5 is hereby incorporated by reference herein.

FIELD OF THE DISCLOSURE

The present invention relates to a device, method and apparatus for lifting a railway rail.

BACKGROUND

There are different ways of joining railway rails together to form tracks. One such way is to bolt rails together to form jointed track. In this form of track, lengths of rail, usually around 20 meters in length, are laid and fixed into position. In the UK the track lengths are traditionally fixed to sleepers, and in the USA they are traditionally fixed with crossties, or simply ties. Once laid, the track lengths are then joined together with steel plates, known as fishplates or joint bars.

Small gaps are deliberately left between the rails, which are known as expansion joints, to allow for thermal expansion of the rails in hot weather. Additionally, the holes through which the fishplate bolts pass are normally oval to allow for expansion.

Unless well maintained, jointed track provides a characteristic bumpy, noisy and uncomfortable ride due to the presence of the expansion joints, and is unsuitable for high speed trains because it is too weak.

The rail industry commonly uses Continuously Welded Rail (CWR) on all major tracks. In this form of track, the rails are welded together for several kilometers, to form one long continuous rail. This avoids the need for expansion gaps, and because there are few joints the rail is very strong and provides a smooth surface for high speed running. Because of its strength, trains traveling on welded track can travel at higher speeds and with less friction. Welded rails are more expensive to lay than jointed tracks, but are significantly cheaper to maintain.

As mentioned above, rails expand in hot weather (and contract in cold weather). As welded track has very few expansion joints, it could become distorted in hot weather and cause a derailment. In order to compensate for thermal expansion in the welded rail, it is laid with significant tension. This process is commonly known as stressing, and ensures that the rail will not expand much further in subsequent hot weather.

The load applied to the rail to produce the tension is calculated so that, at a locally determined temperature, the rail will expand to reduce the tension to zero. This temperature is known as the stress free temperature (SFT). The SFT varies from country to country, and in the UK is normally 27° C.

FIG. 1A of the accompanying drawings is a diagram which illustrates a method for tensioning lengths of rail.

Two lengths of rail 10 and 20 are laid upon a number of sleepers. The rail lengths are laid such that a calculated gap 30 exists between the cut ends. The gap is calculated based on the SFT, and the expansion coefficient of the rail. Each length of rail 10, 20 shown in FIG. 1A is 900 meters long, however each length of rail can be of any length. The end 40, 50 of each length of rail 10, 20 furthest from the gap 30, is clipped onto the sleepers for a length of more than 20 m. This is known as the anchor length. Tensing machines (normally hydraulic) are attached to the free ends of the rails 60, 70 and the rails are pulled towards each other with a force of approximately 60 tons. This force can vary depending on the type of rail and individual site conditions. This tensile force extends the rail lengths 10, 20 until the free ends 60, 70 meet. Once the free ends meet, they may be welded together to form a continuous rail length.

FIG. 1B of the accompanying drawings is a graph illustrating the distribution of rail extension along the unclipped length of a rail in an ideal situation (full line), and in a practical situation (dashed line). Ideally, the extension in the rail length is evenly distributed along the unclipped length. In practice, however, friction between the rail length and the sleeper fittings causes most of the extension to occur close to the tensing point (the initially free end). The consequence of this is to concentrate the load nearest the gap and thus overstress the rail at the weld. This can lead to rail breaks. At the other end, nearest to the anchor, the rail can be unstressed and may buckle in hot weather due to thermal expansion.

In order to reduce these friction effects, existing practice is to use rollers, spaced intermittently along the unclipped length, during the tensing operation. Further, if the track is curved, additional side rollers are employed to keep the rail in the correct position and to resist the tendency for the rail to move towards the center of curvature.

In this existing practice, the rail is lifted by means of jacks, the rollers inserted under the bottom of the rail, and the jacks lowered. Rollers used in the existing practice are simple devices mounted on flat plates. Alternatively, as used in France, the rollers may be lengths of steel bar placed between the rail and the concrete sleeper top.

There are a number of problems with the above-mentioned existing practice.

The use of separate jacks, rollers and side rollers is inconvenient, and as a result the rail stressing process is time-consuming and expensive. Firstly, the use of separate pieces of equipment may necessitate the involvement of several people in order to coordinate the rail-lifting step, the placement of rollers and side rollers, and the rail-lowering step. The lifting of a heavy rail and the placing of rollers thereunder is a hazardous operation for hands that may become trapped.

Although the existing rollers relieve significant friction which would otherwise oppose extension of the rail, they still exert some drag to the free movement of the rail. The existing rollers commonly bear on the underside face of the base (or foot) of the rail. This underside face is normally close to the ground when the rail is in its working position, and is therefore subject to corrosion and may pick up debris. Rolling on this surface is not ideal.

GB 2334692 discloses a railway-rail-lifting tool having a handle at one end, and a system of jaws at the other end. In use, the jaws are placed around the head part of a section of rail, and on lifting of the handle the jaws are caused to grip on the rail for secure lifting. Such a tool requires simple lifting of the rail by hand, and as a result only very small lengths may be lifted for any reasonable length of time. Further, separate rollers and side rollers must be used in conjunction with this rail lifting tool. As above-mentioned, it is inconvenient to have to use separate rollers and side rollers.

U.S. Pat. No. 1,663,061, and GB 1035743 disclose railway-rail-lifting tools incorporating a simple lever mechanism, by which a railway rail may be lifted by hand. Separate rollers and side rollers must be used in conjunction with these rail lifting tools. As above-mentioned, it is inconvenient to have to use separate rollers and side rollers.

WO 01/96663 and FR 2488577 disclose roller clamp apparatuses for use in lifting a railway rail. The apparatuses comprise a parallel pair of spaced-apart lift roller assemblies. In the case of WO 01/96663, each roller rotates on an essentially vertical axis. In the case of FR 2488577, each roller rotates on an essentially horizontal axis.

In each case, the roller assemblies are mounted to a support for positioning the pair for clamping to a railway rail. In order to lift the rail, the apparatuses must be connected to a carrier. That is, the apparatuses must be supported by an off track machine such as a crane or gantry. It is considered disadvantageous that such an off track machine be required. Such off track machinery is commonly expensive, requires regular maintenance, may require a large electrical power source, and can be difficult to transport and position securely for use.

SUMMARY OF THE DISCLOSURE

It is desirable to provide a device, method and apparatus which solves the above-mentioned problems. It is further desirable to provide a device capable of lifting a rail and maintaining the rail in a lifted position. It is further desirable to provide a device capable of allowing substantially free extension of a rail under a tensile force, such that a distribution of the extension along the rail approaches the ideal distribution as shown in FIG. 1B. It is further desirable to provide a single device capable of replacing existing jacks, rollers and side rollers. It is further desirable to provide a device capable of being operated by hand, such that no off track machinery is required. It is further desirable to provide a device capable of lifting a rail from a surface other than the underside face of the rail foot.

According to an embodiment of a first aspect of the present invention, there is provided a railway-rail-lifting device for lifting a railway rail, the device comprising: an arm; and a roller rotatably mounted to the arm; the arm being operable to be rotated to bring the roller to bear on the rail such that the roller exerts a lifting force thereon; characterised by securing means operable to releasably secure the device to a rail fastening assembly. Such a device advantageously renders a separate jack and roller unnecessary. Furthermore, by eliminating the need for a separate jack and roller, the above-mentioned problems and safety hazards associated with coordinating the use of such jacks and rollers are also eliminated. The use of the existing rail fastening assembly to locate the device is advantageous, as it avoids the need to provide other means to which the device may be secured.

The securing means may further be operable to secure the device to a fastener housing portion of the rail fastening assembly, optionally such that the fastener may remain attached to the rail fastening assembly. The securing means may comprise a locking handle, or push button, operable to secure and release the device. Such a locking handle or push button may preferably be operable by hand, such that no additional machinery or tooling is required.

Railway rails generally have a head section and a foot section, the head section having an underside face. Preferably, the arm may be operable to be rotated such that the roller is brought to bear on a portion of said underside face. One advantage of bringing the roller to bear on a portion of the underside face is that that surface genera tends to be clean and free from corrosion and debris, which enables the roller to run freely.

Preferably, the roller is brought into direct contact with the rail. This may advantageously enable a high degree of mechanical efficiency as motion of the extending rail is transferred directly to the roller. Alternatively, however, the roller may have a protective cover, and/or another element placed between the roller and the rail, such that the roller is not brought into direct contact with the rail. This may increase the working life of the roller, the protective cover (and/or the other element) being relatively inexpensive to replace.

Preferably, the roller may be mounted such that a width of the roller's outer face is substantially parallel with the portion of said underside face when the roller is brought to bear thereon. That is, the roller may be mounted at an angle to match the underside surface of the rail when the device is in use. In this way, the surface area of the roller bearing the weight of the rail may be advantageously maximised.

Preferably, the roller is mounted such that its axis of rotation is substantially perpendicular to a longitudinal axis of the rail when the roller is brought to bear on the rail. It is advantageous that those axes are perpendicular, because an uppermost portion of the outer surface of the roller will thereby move in substantially the same direction as the rail when it is extended longitudinally. Thus, any slippage between the outer surface of the roller and the rail which would cause mechanical loss through friction is minimised. Further, by allowing a relatively free motion of the rail in the direction of extension, it is possible that a distribution of the extension along the rail length may approach the ideal distribution as shown in FIG. 1B.

Preferably, the roller may be operable, when exerting a lifting force on the rail, to exert a position-maintaining force on the rail so as to resist a movement of the rail. In this way, motion of a curved rail length towards the center of curvature may be resisted without the need for additional side rollers.

The device may further comprise transmitting means operable to transmit a force to the arm so as to rotate the arm. In this way, it is possible to avoid the need for additional transmitting means. The transmitting means may, optionally, comprise a shaft coupled to the arm. The shaft may preferably be mounted in at least one axial bearing, and/or with at least one thrust bearing. Such an axial bearing may enable substantially low friction rotation of the shaft about its axis, and may also enable substantially low friction motion of the shaft along its axis. Such a thrust bearing may limit motion of the shaft along its axis. Since the roller is mounted to the arm, and the arm may be optionally coupled to the shaft, such a thrust bearing may thereby enable the roller to exert the above-mentioned position-maintaining force.

Preferably, the transmitting means of the device may further comprise a handle or lever temporarily attachable to the shaft. Further, such a handle or lever may be configured such that a force applied to the handle or lever by hand generates a lifting force. By enabling the rail to be lifted by hand, additional off track machinery may be advantageously avoided.

Optionally, the device may comprise a motor coupled to the transmitting means and operable to generate the rotating force necessary for the roller to lift the arm. The motor may be permanently coupled to the transmitting means or detachably coupled thereto, such that one motor may be used with several devices. The use of an electrical motor may advantageously limit the amount of energy required by an operator of the device.

The roller of the device may be a bearing, and preferably a precision bearing. Such a bearing may advantageously provide a lifting surface which is capable of rotating under low friction conditions.

The device may further comprise rotation limiting means operable to limit the rotation of the arm. The rotation means may comprise a member located across a path of rotation of the arm, so as to limit that path. The rotation means may, for example, limit the path of motion of the arm from a horizontal position through an angle of rotation θ. The angle of rotation θ is preferably greater than 90 degrees, and may optionally be equal to 100 degrees. It is advantageous that the angle θ be greater than 90 degrees, such that the arm may be brought through an upwardly vertical position during lifting. In this way, the weight of the rail bearing on the roller may keep the arm in the lifted position. That is, preferably a further lifting force must be exerted on the rail to rotate the arm back through the vertical position to subsequently lower the rail. An additional lock may be employed to prevent rotation of the arm.

According to an embodiment of a second aspect of the present invention, there is provided a railway-rail-lifting method for lifting a railway rail, the method comprising: rotating the arm of a device embodying the aforementioned first aspect of the present invention to bring the roller to bear on the rail such that the roller exerts a lifting force thereon.

According to an embodiment of a third aspect of the present invention, there is provided railway-rail-lifting apparatus for lifting a railway rail, the apparatus comprising two of said devices embodying the aforementioned First aspect of the present invention, wherein the rail has first and second underside faces on opposite sides of the rail, and wherein the arm of a first one of the said devices is operable to be rotated such that the roller of the first device is brought to bear on a portion of said first underside face, and wherein the arm of a second one of the said devices is operable to be rotated such that the roller of the second device is brought to bear on a portion of the second underside face.

Preferably, the first and second devices are operable to exert their respective first and second lifting forces simultaneously. In that case, and assuming that no other lifting force is exerted on the rail, the sum of said first and second lifting forces need only be at least equal to a force required to lift the rail.

Advantageously, a number of apparatuses according to the aforementioned third aspect of the present invention may be used simultaneously at various locations along a rail. In that case, the sum of lifting forces of all the apparatuses need only be at least equal to a force required to lift the rail. In this way, the lifting and lowering process may be safe and well controlled since the rail is supported in a number of locations therealong.

It is advantageous to use first and second devices on opposite sides of the rail in order to stabilise the rail on lifting, and prevent lateral movement of the rail. In this way, it may be possible to ensure that the rail is positioned centrally with respect to the rail fastening assembly throughout extension of the rail, in order to facilitate reattachment of the rail to the rail fastening assembly after the tensioning is complete. Such lateral movement may be movement towards or away from a center of curvature in the case of a curved rail section.

BRIEF DESCRIPTION OF THE SEVERAL VIEWS OF THE DRAWING

Reference will now be made, by means of example, to the accompanying drawings, in which.

DETAILED DESCRIPTION OF THE PREFERRED EMBODIMENTS

Figure 1A:
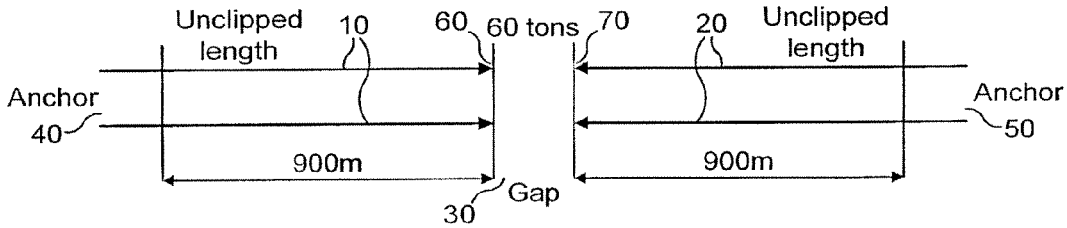
FIG. 1A (described above) is a diagram which illustrates a method for tensioning lengths of rail.
Figure 1B:
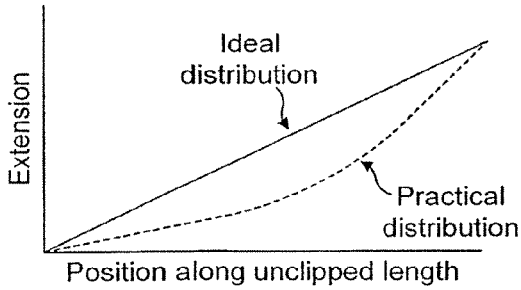
FIG. 1B (described above) is a graph illustrating the distribution of rail extension along the unclipped length of a rail in an ideal situation, and in a practical situation.
Figure 2:
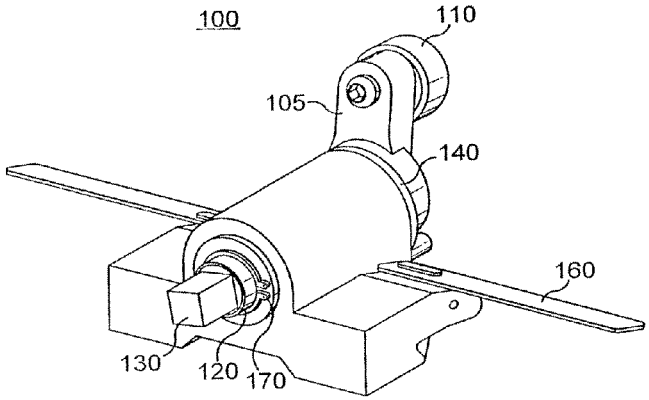
FIG. 2 is a perspective view of a device according a first embodiment of the present invention.

FIG. 2 of the accompanying drawings shows a device 100 according to a first embodiment of the present invention. Device 100 comprises a lift arm 105, a roller comprising a bearing 110, a shaft 120, a spacer 140, a mount assembly 150, two locking handles 160, and a circlip 170.

The bearing 110 is rotatably mounted at a predetermined angle to one end of the arm 105. The arm 105 is coupled at its other end to one end of the shaft 120. The shaft is substantially housed within the mount assembly 150, preferably in at least one axial bearing (not shown), and/or with at least one thrust bearing (not shown).

Spacer 140 is located between the arm 105 and the mount assembly 150, so as to maintain a minimum distance between the arm 105 and the mount assembly. It is envisaged that spacer 140 is an optional component of device 100. Circlip 170 is located on a portion of the shaft 120 protruding out of the mount assembly 150 away from the arm 105. The shaft 120 is free to move axially within the mount assembly 150, but the travel is limited, in this case to 6 mm, by means of either the arm 105 abutting a thrust bearing (or thrust washer) via the optional spacer 140, or the circlip 170 abutting a thrust bearing (or thrust washer).

An end portion 130 of the shaft 120, opposite to the end of the shaft coupled to the arm 105, has a square cross-section. A lever or handle (not shown) having a complementary attachment portion, for example a matching square hole, may be temporarily attached thereto. The end portion 130 may have any cross-section providing that the end portion and its lever or handle have complementary attachment means for connecting them together.

The mount assembly 150 forms the main body of the device 100, providing support for the shaft 120 and the arm 105. Locking handles 160, coupled to the mount assembly 150, form part of securing means operable to secure the device 100 in a fixed position. Such securing means are partly housed within the mount assembly 150. Locking handles 160 are operable to secure the device 100 to a rail fastening system (not shown in FIG. 2), in particular the PANDROL FASTCLIP™ housing, such that the device may withstand high loads associated with rail lifting. Mount assembly 150 is designed such that a fastener of the rail fastening system may remain within the fastener housing portion in the withdrawn position. Although mount assembly 150 is designed to fit a PANDROL FASTCLIP™ rail fastening system, it could also be designed to fit another type of rail fastening system, such as a system employing a PANDROL "e"-CLIP™ type of fastener, or to be generic to many types of rail fastening system. Although the device 100 has two locking handles 160, it is envisaged that another embodiment of the present invention could comprise only one locking handle, or alternatively securing means not having any locking handles.

A stop pin (not shown) is provided in the mount assembly 150, which may engage with a feature in the arm 105 to prevent rotation of the arm 105 past a predetermined position. The stop pin of device 100 is positioned so as to allow the arm 105 to rotate from a horizontal position through an angle of 100 degrees to a position 10 degrees past an upwardly vertical position.

In use, after a rail has been detached from a Pandrol FASTCLIP™ rail fastening system, device 100 is secured to a fastener housing portion thereof using the securing means and locking handles 160. A lever or handle is attached to end 130 of the shaft 120. The lever or handle is rotated to rotate the arm 105 from a substantially horizontal position towards an upwardly vertical position such that the bearing 110 is brought into direct contact with an underside face of the head portion of the rail. The predetermined angle at which the bearing is mounted to the arm 105 is set such that the portion of the outer surface of the bearing brought into contact with the underside face of the rail is substantially parallel thereto. The lever or handle is further rotated, lifting the rail, until a feature of the arm 105 engages with the stop pin, such that no further rotation is permitted. In this position, the lever or handle may be removed from the device 100 or left in position, the weight of the rail maintaining the position of the arm 105 relative to the stop pin. An additional or alternative lock may be used to maintain the position of the arm 105.

In the lifted position, any longitudinal movement of the rail, for example extension of the rail as a result of any tensile force applied thereto, will cause the bearing 110 to rotate. Advantageously, due to the low friction rotation properties of the bearing 110, the rail may move longitudinally in the lifted position substantially freely. Conversely, any lateral movement of the rail towards the bearing 110, for example towards a center of curvature in the case of a curved section of rail, will be resisted since the device 100 is securely fixed to the rail fastening assembly. Advantageously, lateral movement of the rail towards device 100 is substantially prevented, maintaining the lateral position of the rail such that it may be lowered into a position for refastening to the rail fastening assembly.

The rail is lowered by reattaching (if necessary) the lever or handle to the shaft 120 and rotating it to rotate the arm back through the upwardly vertical position back to the horizontal position, such that the rail is brought to rest with the bearing not directly contacting the rail. In this position, locking handles 160 are used to release device 100 from the rail fastening assembly. The rail may then be refastened to the rail fastening assembly.

Although a lever or handle is used to provide the force necessary to rotate arm 105 for lifting and lowering, it is envisaged that a motor permanently or temporarily attached to the shaft 120 could be used to provide the necessary force.

Figure 3:
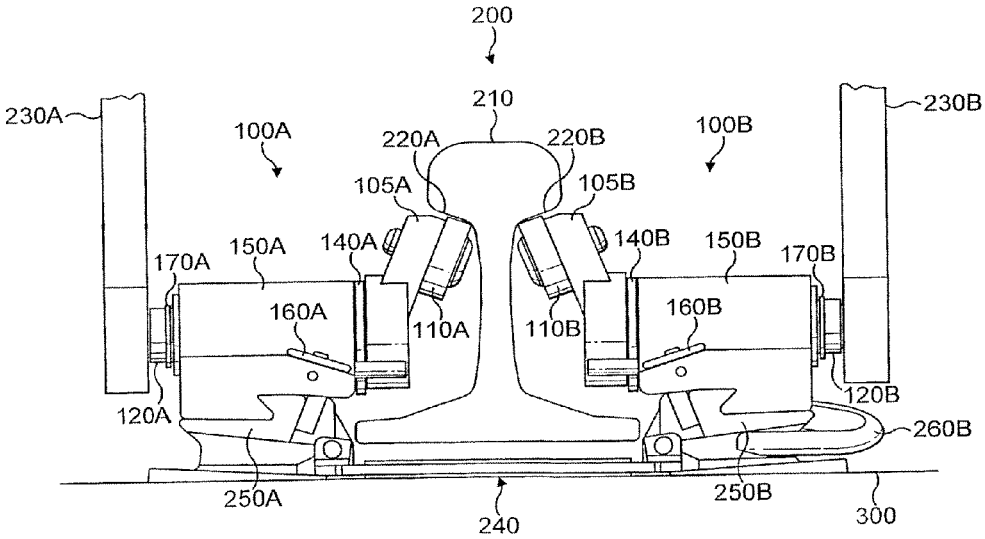
FIG. 3 is across-sectional view of apparatus according to a second embodiment of the present invention in use.
Figure 4:
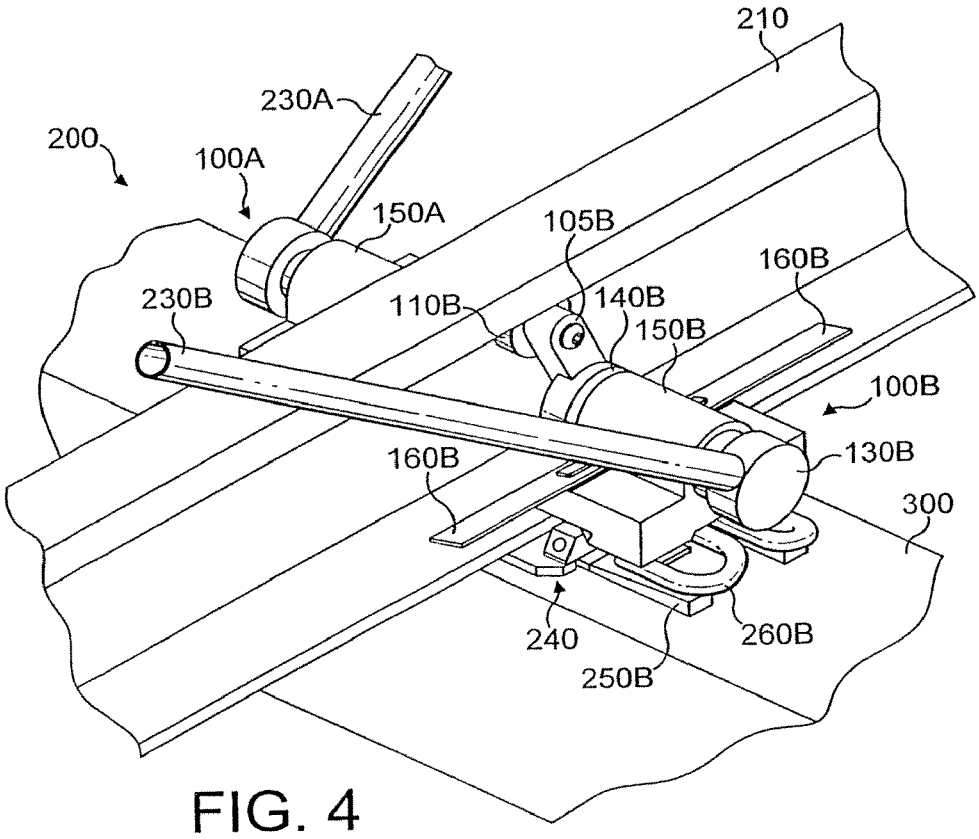
FIG. 4 is a perspective view of the second embodiment of e present invention in use.

FIG. 3 of the accompanying drawings is a cross-sectional view of apparatus 200 according to a second embodiment of the present invention in use. FIG. 4 of the accompanying drawings is a perspective view of the second embodiment of the present invention in use.

Apparatus 200 comprises two devices 100A and 100B, each substantially identical to the aforementioned device 100. In addition to apparatus 200, FIG. 3 shows a rail 210, two levers 230A and 230B, and a rail fastening assembly 240 which rests upon a sleeper 300.

Those parts of devices 100A and 100B already described with reference to device 100 of FIG. 2 have been numbered in the same way, but with additional respective suffixes A and B. Accordingly, unnecessary duplicate description of those parts is omitted.

Devices 100A and 100B are shown maintaining the rail 210 in the lifted position. Device 100A is secured to one rail fastener housing 250A of the rail fastening assembly 240. Similarly, device 100B is secured to the other rail fastener housing 250B of the rail fastening assembly 240. A rail fastener 260B remains within rail fastener housing 250B in a withdrawn position. Another rail fastener (not shown) could remain within rail fastener housing 250A in a withdrawn position.

Levers 230A and 230B are located on shafts 120A and 120B, respectively. Bearings 110A and 110B are in direct contact with underside faces 220A and 220B of the head section of the rail 210. Underside faces 220A and 220B are clean blemish-free surfaces on which bearings 110A and 110B can run.

Spacers 140A and 140E ensure that arms 105A and 105B are distanced from mount assemblies 150A and 150B, such that rail 210 is held centrally between rail fastener housings 250A and 250B. That is, apparatus 200 ensures that no substantial lateral movement of rail 210 is permitted. No additional side rollers are required.

In use, levers 230A and 230B are rotated simultaneously to ensure balanced lifting and lowering of the rail 210. The mechanical advantage afforded by levers 230A and 230B enables rail 210 to be lifted by hand.

Figure 5:
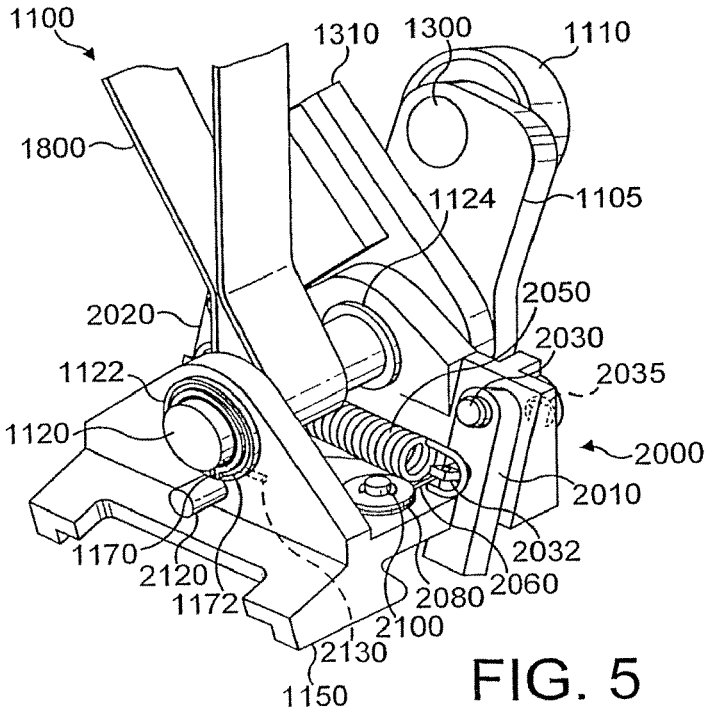
FIG. 5 is a perspective view of a third embodiment of the present invention.

FIG. 5 of the accompanying drawings shows a device 1100 according to a third embodiment of the present invention. Device 1100 comprises a lift arm 1105, a roller comprising a bearing 1110, a bearing shaft 1300, a shaft 1120, a handle stub 1310, two bearings 1122 and 1124, a circlip 1170, a washer 1172, a mount assembly 1150, a carrying strap 1800, and securing means 2000.

Securing means 2000 comprises two locking fingers 2010 and 2020, two finger pins 2030 and 2040 (not shown), two finger spring pins 2032 and 2042 (not shown), a finger spring 2050, two bell cranks 2060 and 2070 (not shown), two washers 2080 and 2090 (not shown), two finger circlips 2100 and 2110 (not shown), push button 2120, and roll pin 2130.

The bearing 1110 is rotatably mounted onto bearing shaft 1300, which is itself mounted to one end of the arm 1105 such that bearing 1110 is mounted at a predetermined angle relative to the arm 1105. The arm 1105 is coupled at its other end to one end of the shaft 1120. The shaft is supported within the two bearings 1122 and 1124 such that it can rotate about its axis. Bearings 1122 and 1124 are located partially within the mount assembly 1150.

Circlip 1170 and washer 1172 are located on a portion of the shaft 1120 protruding out of the bearing 1122 away from the arm 1105. The shaft 1120 is free to move axially within the bearings 1122 and 1124, but its freedom of travel longitudinally towards the arm 1105 is limited by the presence of the washer 1172 and circlip 1170.

Handle stub 1310 is coupled to the shaft 1120 adjacent to the lift arm 1105. A lever or handle (not shown), having an attachment portion suitable for attachment to the handle stub 1310, may be temporarily attached thereto.

The mount assembly 1150 forms the main body of the device 1100, providing support for the shaft 1120 and the arm 1105. Securing means 2000 is mounted on, and partially within, mount assembly 1150. Securing means 2000 is operable to secure the device 1100 in a fixed position onto a rail fastening system, in particular to the housing of a PANDROL FASTCLIP™ rail fastening system, such that the device may withstand high loads associated with rail lifting. Mount assembly 1150 is designed such that a fastener of the rail fastening system may remain within the fastener housing portion in the withdrawn position. Although mount assembly 1150 is designed to fit a PANDROL FASTCLIP™ rail fastening system, it could also be designed to fit another type of rail fastening system, such as a system employing a PANDROL "e"-CLIP™ type of fastener, or to be generic to many types of rail fastening system.

Carrying strap 1800 is loosely attached to the shaft 1120 between the bearings 1122 and 1124. Carrying strap 1800 is made of nylon, although it could be made of another material, such as leather. Carrying strap 1800 is sufficiently strong enough to support the weight of device 1100. A typical weight of device 1100 is 3 kg. Accordingly, device 1100 is portable.

A stop pin (not shown) may be optionally provided in the mount assembly 1150, which may engage with a feature in the arm 1105 to prevent rotation of the arm 1105 past a predetermined position. Such a stop pin may be positioned so as to allow the arm 1015 to rotate from a horizontal position through an angle of 100 degrees to a position 10 degrees past an upwardly vertical position.

The two locking fingers 2010 and 2020, of securing means 2000, are rotatably mounted to the mount assembly 1150 via the two finger pins 2030 and 2040. Each said finger pin is retained in its mounted position by a circlip 2035. The two locking fingers 2010 and 2020 extend downwardly from the two finger pins 2030 and 2040, and can rotate relative to the mount assembly 1150 in a plane substantially orthogonal to the axis of shaft 1120. The two locking fingers 2010 and 2020 have finger spring pins 2032 and 2042 mounted thereto, respectively. Finger spring 2050 is attached at one end to finger spring pin 2032, and at the other end to finger spring pin 2042. Finger spring 2050 spring biases locking fingers 2010 and 2020 into a locked position in which they are rotated towards one another. When device 1100 is in its working disposition, for example located on a PANDROL FASTCLIP™ rail fastening housing, locking fingers 2010 and 2020 are spring biased into the locked position, which locks device 1100 to the housing of the rail fastening system.

Bell cranks 2060 and 2070 are rotatably mounted onto mount assembly 1150, and are secured into place with washers 2080 and 2090, and finger circlips 2100 and 2110. Bell cranks 2060 and 2070 are operable to rotate such that they engage with locking fingers 2010 and 2020, respectively, such that they cause locking fingers 2010 and 2020 to rotate away from one another into an unlocked position. As abovementioned, however, the finger spring 2050 biases locking fingers 2010 and 2020 into the locked position. Accordingly, in the absence of an unlocking force applied to bell cranks 2060 and 2070, locking fingers 2010 and 2020 remain in the locked position.

Push button 2120 is located within a hole formed in mount assembly 1150. Roll pin 2130 is mounted partially within push button 2120, such that its ends protrude out of the sides thereof. Roll pin 2130 may guide the passage of the push button 2120 through the hole, and/or prevent push button 2120 from inadvertently falling out of the hole. To release device 1100 from its working disposition, push button 2120 may be pushed so that it engages with bell cranks 2060 and 2070, and causes them to rotate so as to push locking fingers 2010 and 2020 away from one another into the unlocked position.

Push button 2120, when pushed, engages with both bell cranks 2060 and 2070 together. Accordingly, if either of the locking fingers is stuck into the locked position, for example due to a fault in either of the bell cranks (or in either of the locking fingers), the device 1100 will remain locked, and a user will be alerted to the presence of such a fault.

In use, after a rail (not shown) has been detached from the rail fastening system, device 1100 is secured to a fastener housing portion thereof using the securing means 2000. A lever or handle (not shown) is attached to the handle stub 1310. The lever or handle is rotated to rotate the arm 1105 from a substantially horizontal position towards an upwardly vertical position such that the bearing 1110 is brought into direct contact with an underside face of the head portion of the rail. The predetermined angle at which the bearing 1110 is mounted relative to the arm 1105 is set such that the portion of the outer surface of the bearing brought into contact with the underside face of the rail is substantially parallel thereto. The lever or handle is further rotated, lifting the rail, until a feature of the arm 1105 engages with the stop pin, such that no further rotation is permitted. In this position, the lever or handle may be removed from the handle stub 1310 or left in position, the weight of the rail maintaining the position of the arm 1105 relative to the stop pin. An additional or alternative lock may be used to maintain the position of the arm 1105.

In the lifted position, any longitudinal movement of the rail, for example an extension of the rail as a result of any tensile force applied thereto, will cause the bearing 1110 to rotate. Advantageously, due to the low friction rotation properties of the bearing 1110, the rail may move longitudinally in the lifted position substantially freely. Conversely, any lateral movement of the rail towards the bearing 1110, for example towards a center of curvature in the case of a curved section of rail, will be resisted since the device 1100 is securely fixed to the rail fastening assembly. Advantageously, lateral movement of the rail towards device 1100 is substantially prevented, maintaining the lateral position of the rail such that it may be lowered into a position for refastening to the rail fastening assembly.

The rail is lowered by reattaching (if necessary) the lever or handle to the handle stub 1310 and rotating it to rotate the arm back through the upwardly vertical position back to the horizontal position, such that the rail is brought to rest with the bearing not directly contacting the rail. In this position, push button 2120 is used to release device 1100 from the rail fastening assembly. The rail may then be refastened to the rail fastening assembly. In one embodiment of the invention, the rail may be refastened to the rail fastening assembly before the device (e.g. device 1100) is released from the rail fastening housing.

Although a lever or handle is used to provide the force necessary to rotate arm 1105 for lifting and lowering, it is envisaged that a motor permanently or temporarily attached to the shaft 1120 could be used to provide the necessary force.

Figure 6:
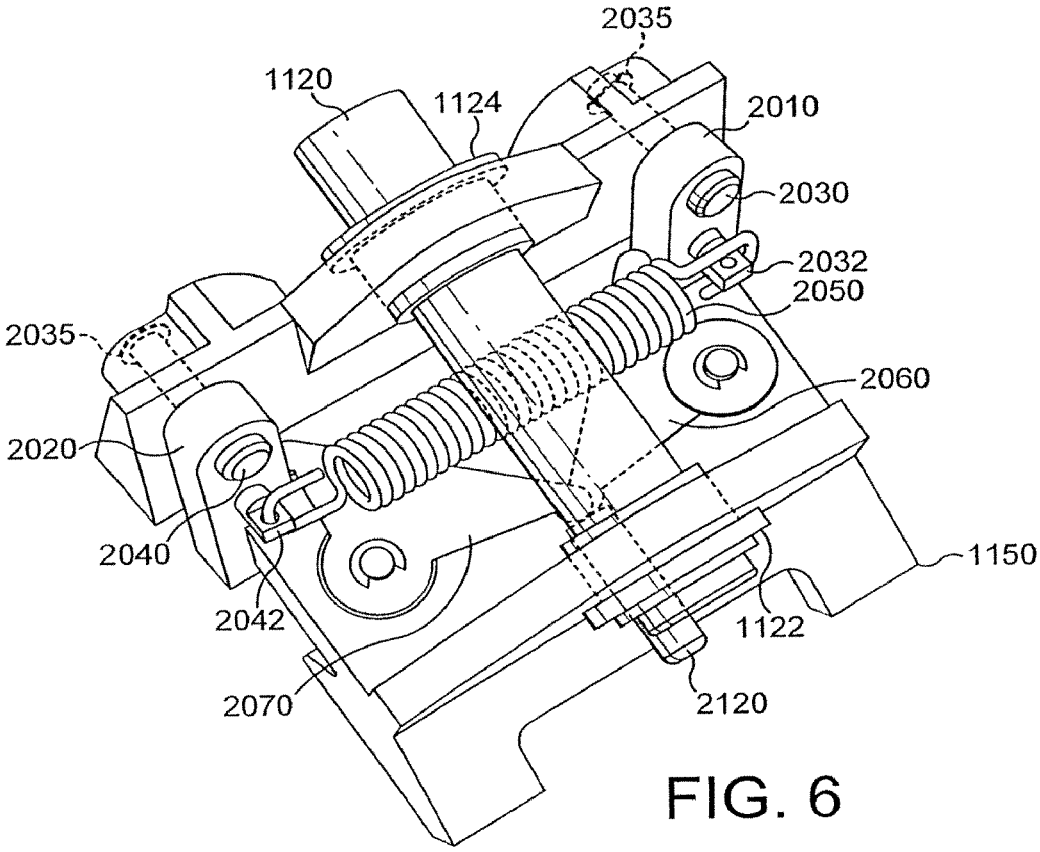
FIG. 6 is a partly ghosted view of a portion of the third embodiment of the invention.

FIG. 6 is a partly ghosted view of a portion of the device 1100. Those parts shown in FIG. 6 that have already been referred to in relation to FIG. 5, have been numbered the same. Shaft 1120 has been ghosted to show bell cranks 2060 and 2070, push button 2120, and finger spring 2050 therebelow.

Figure 7:
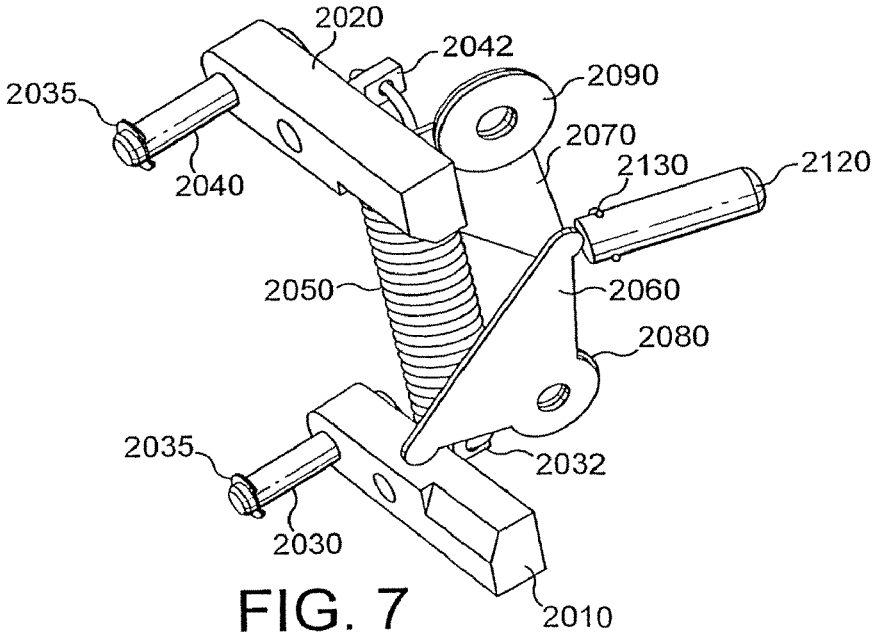
FIGS. 7 and 8 are two different perspective views of the securing means of the third embodiment of the invention.
Figure 8:
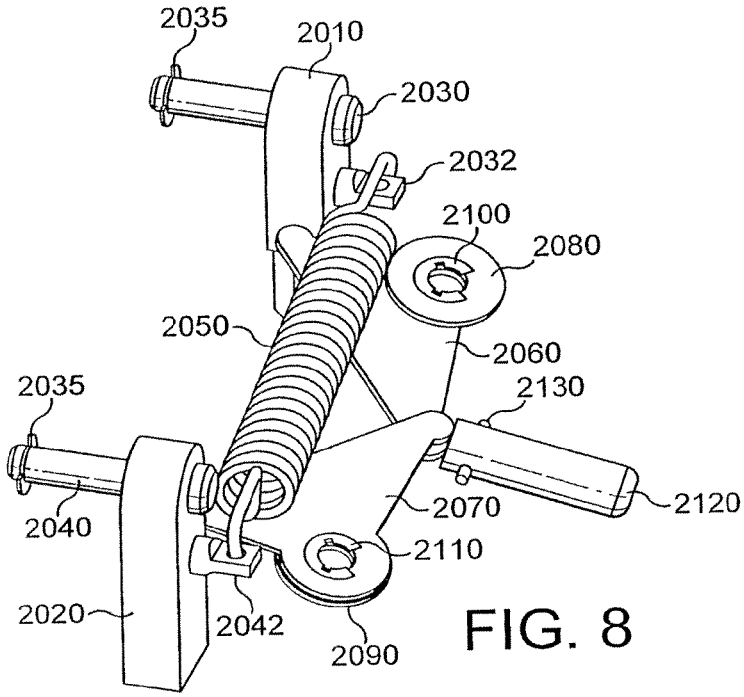

FIGS. 7 and 8 are two different perspective views of the securing means 2000, removed from device 1100. Those parts of securing means 2000 shown in FIGS. 7 and 8 that have already been referred to in relation to FIG. 5, have been numbered the same.

Figure 9:
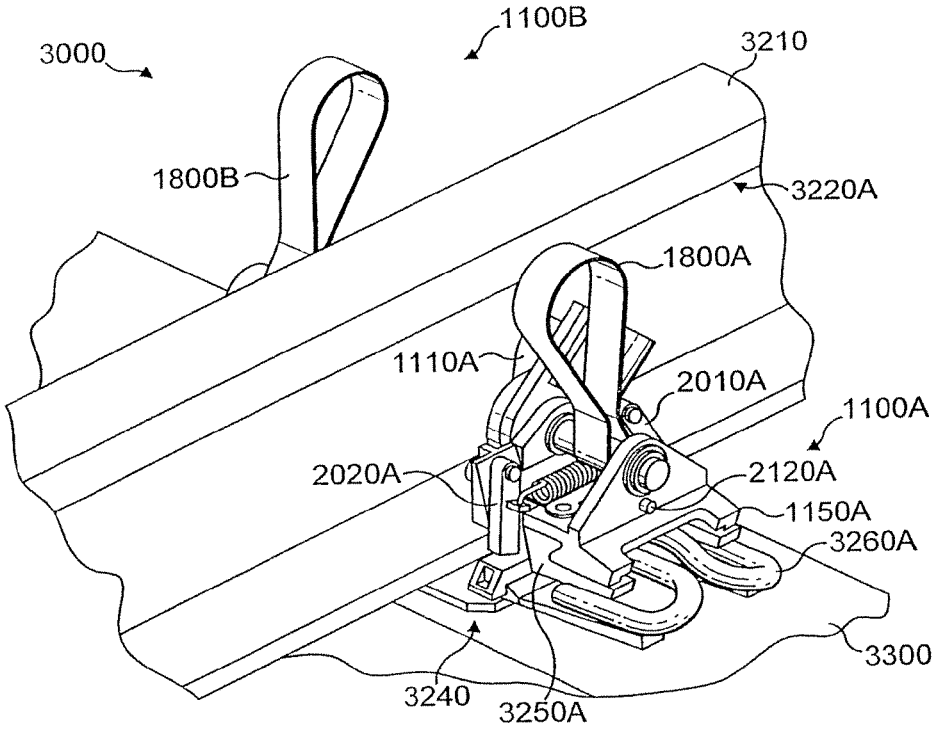
FIGS. 9 to 11 are three views of apparatus according to a fourth embodiment of the present invention in use.
Figure 10:
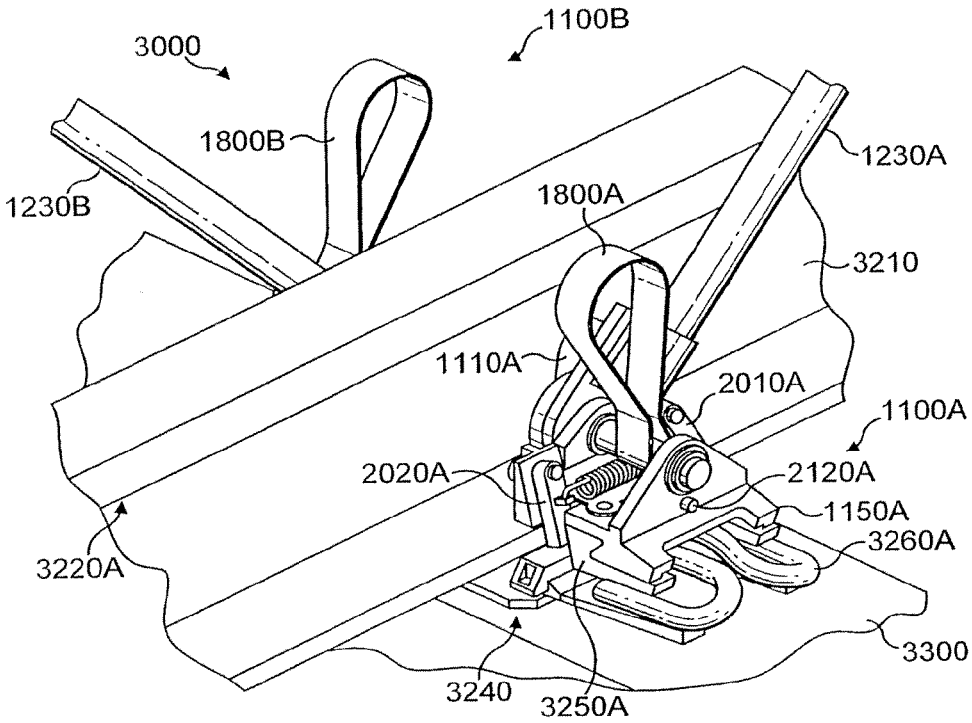
Figure 11:
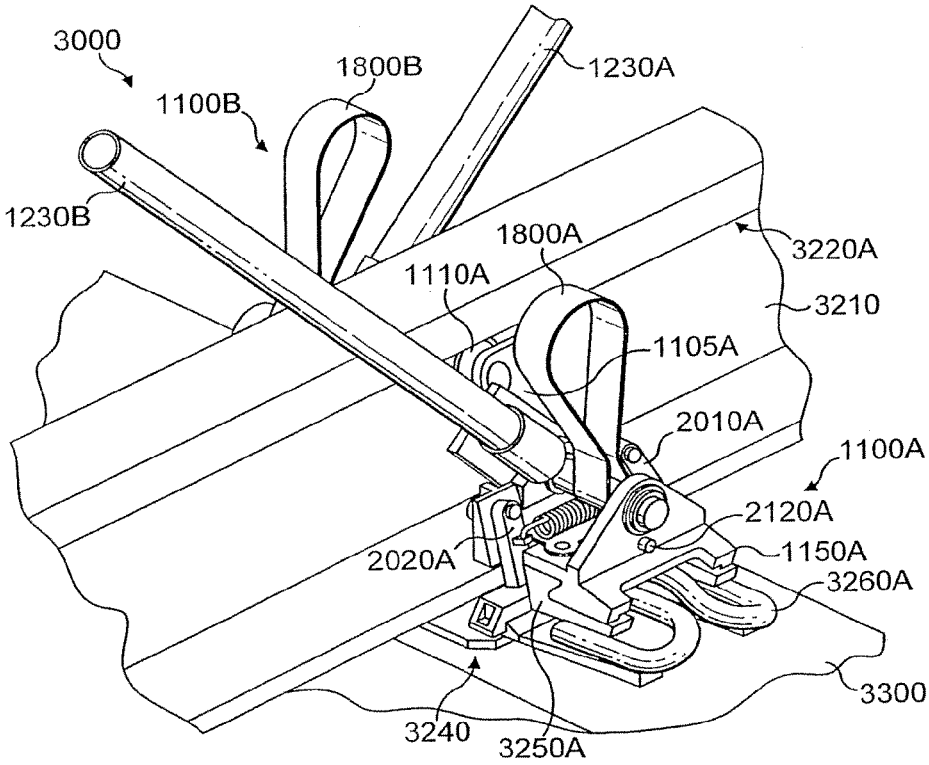
Figure 12A:
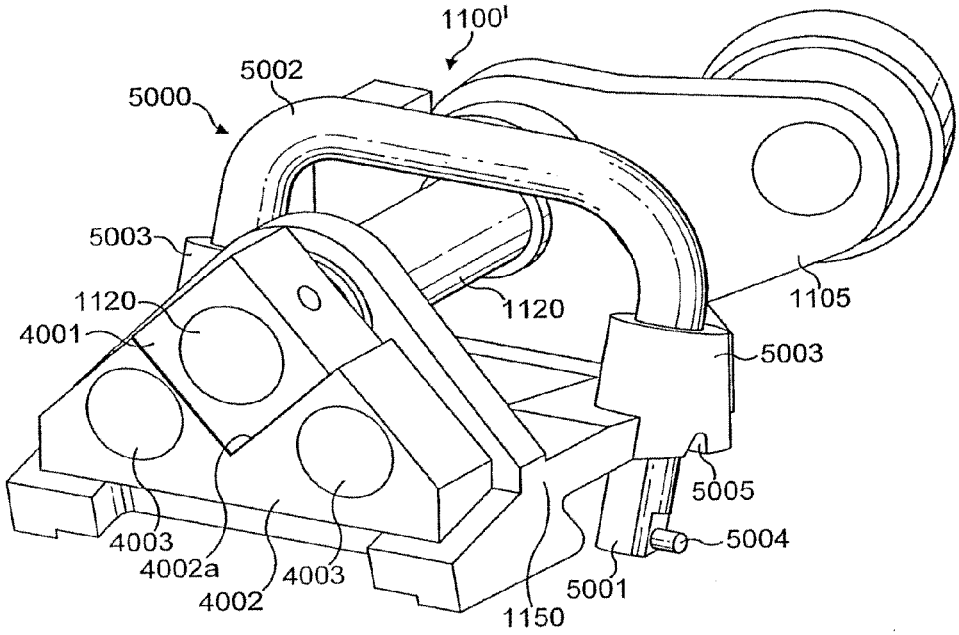
FIGS. 12A to 12E show a fifth embodiment of the present invention
Figure 12B:
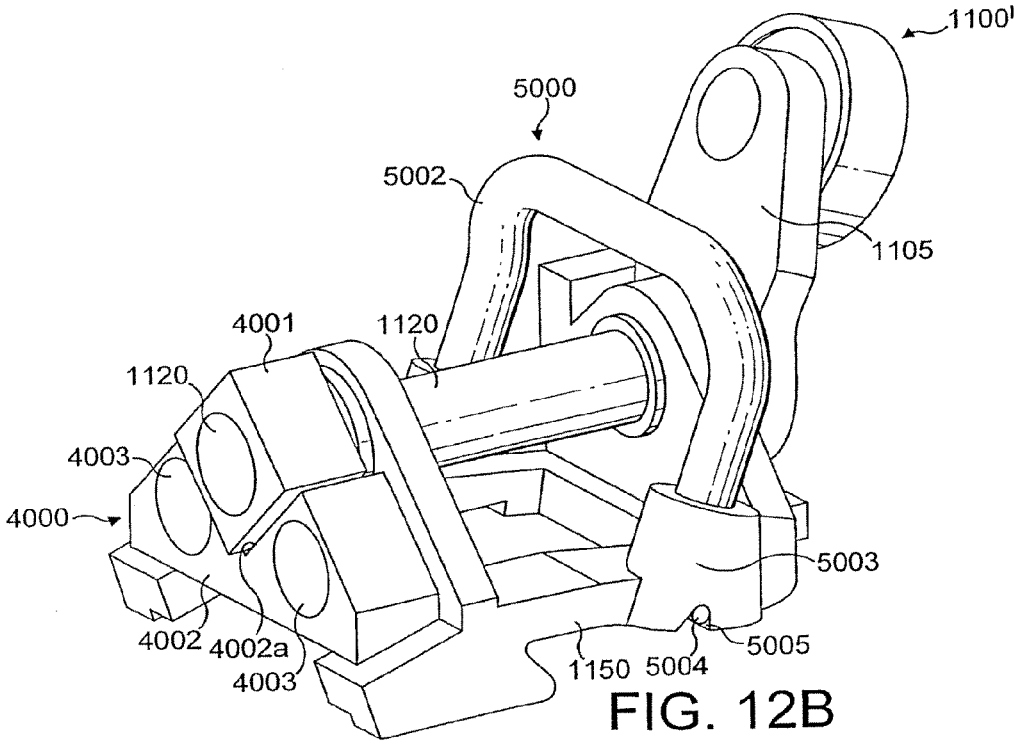
Figure 12C:
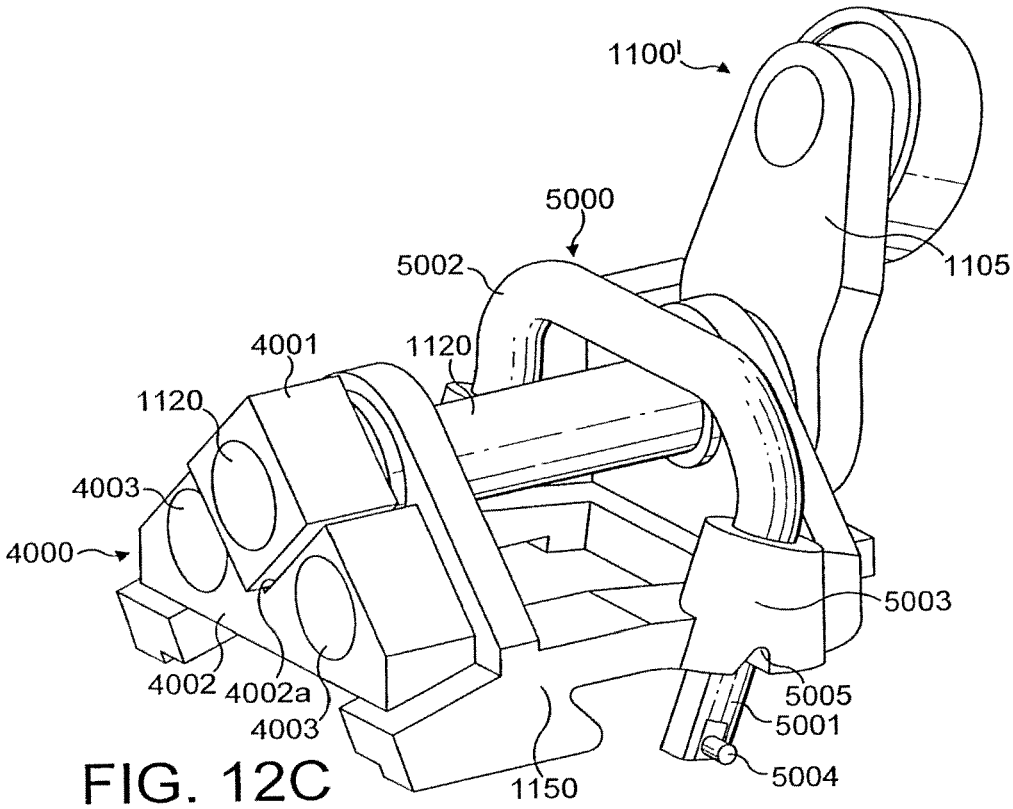
Figure 12D:
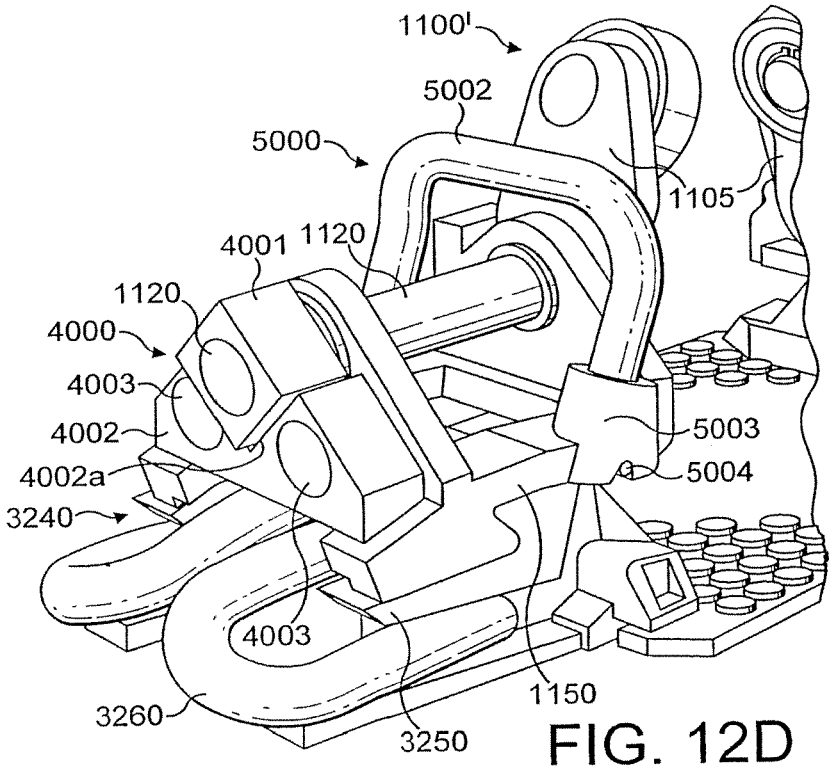
Figure 12E:
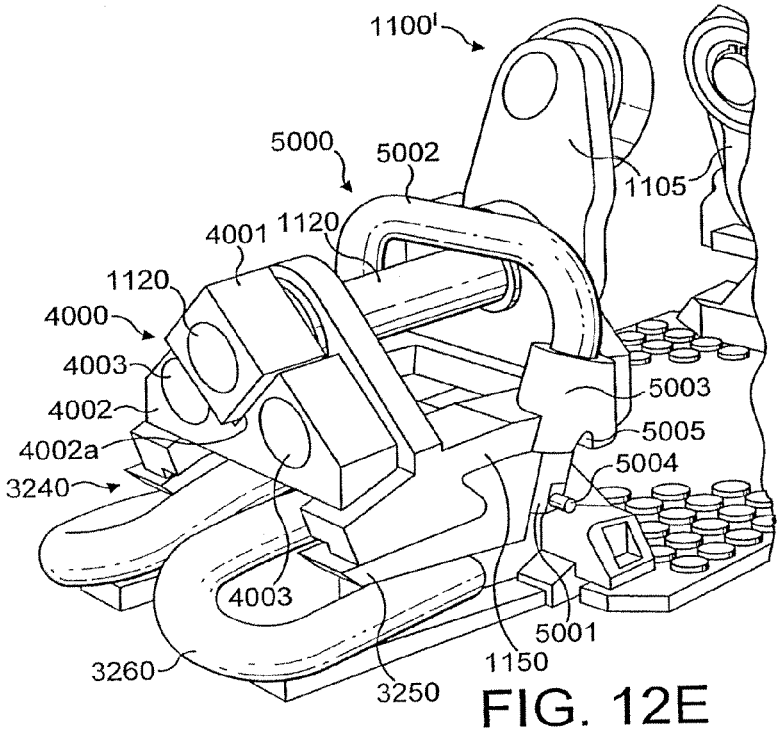

FIGS. 9 to 11 of the accompanying drawings show three perspective views of apparatus 3000 according to a fourth embodiment of the present invention in different stages of use. Apparatus 3000 comprises two devices 1100A and 1100B, each substantially identical to the aforementioned device 1100.

In addition to apparatus 3000. FIGS. 9 to 11 show a rail 3210, and a rail fastening assembly 3240 which rests upon a sleeper 3300.

The reference numerals used in respect of device 1100, also apply to devices 1100A and 1100B, except with additional respective suffixes A and B. Accordingly, unnecessary duplicate description of those parts is omitted.

Turning firstly to FIG. 9, device 1100A is positioned in its working disposition on one rail fastener housing 3250A of the rail fastening assembly 3240. Similarly, device 1100B is positioned in its working disposition on the other rail fastener housing 3250B (not shown) of the rail fastening assembly 3240. A rail fastener 3260A remains within rail fastener housing 3250A in a withdrawn position. Another rail fastener not shown) could remain within rail fastener housing 3250B in a withdrawn position.

Push button 2120A is shown in the pushed position, and accordingly locking fingers 2010A and 2020A are shown in the unlocked position. Device 1100A is therefore not secured in its working disposition. Similarly, device 1100B is also not secured in its working disposition. Devices 1100A and 1100B could be lifted away from their working dispositions using carrying straps 1800A and 1800B, respectively.

Bearings 1110A and 1110B are not in contact with underside faces 3220A and 3220B (not shown) of the head section of the rail 3210, which is therefore not in a lifted position.

In FIG. 10, push button 2120A is shown in the released position, and accordingly locking fingers 2010A and 2020A are shown in the locked position. Device 1100A is therefore secured in its working disposition. Similarly, device 1100B is also secured in its working disposition.

Levers 1230A and 1230B are located on handle stubs 1310A and 1310B, respectively. Similarly to FIG. 9, bearings 1110A and 1110B (not shown) are not in direct contact with underside faces 3220A and 3220B (not shown) of the head section of the rail 3210, which is therefore not in a lifted position.

In FIG. 11, devices 1100A and 1100B are secured in their working dispositions, as in FIG. 10. Levers 1230A and 1230B have both been rotated by hand so as to bring bearings 1110A and 1110B into direct contact with underside faces 3220A and 3220B, respectively, of the head section of the rail 3210. Levers 1230A and 1230B have both been further rotated by hand, and due to the mechanical advantage afforded by those levers, the rail 3210 has been lifted upwards. That is, devices 1100A and 1100B are shown maintaining the rail 3210 in the lifted position.

Underside faces 3220A and 3220B are clean blemish-free surfaces on which bearings 1110A and 1110B can run. Bearings 1110A and 1110B together ensure that no substantial lateral movement of rail 3210 is permitted. No additional side rollers are required.

FIG. 12 shows a device 1100' according to a fifth embodiment of the present invention which is similar in many ways to the device 1100 of FIG. 5. However, the device 1100' differs from that of FIG. 5 primarily in three ways. Firstly, the carrying strap has been omitted. Secondly, the device 1100' is provided with a locking mechanism 4000 for keeping the arm 1105 in a vertical position. The locking mechanism 4000 comprises an end piece 4001 of square profile which is attached to the free end of the shaft 1120 and a locking piece 4002 which has a recess 4002*a* shaped to match the square outline of the end piece 4001, the locking piece 4002 being magnetically attachable to the mount assembly 1150 below the end piece 4001 such that the end piece 4001 abuts the walls of the recess 4002*a*. Thus, rotation of the end piece 4001, and hence of the shaft 1120, is prevented when the locking piece 4002 is in position. The locking piece 4002 may be formed, for example, either entirely of magnetic material or, as shown in FIGS. 12A to 12E, of a casting with embedded magnets 4003.

The third change is to the securing means for securing the device to a PANDROL FASTCLIP™ rail fastener housing. In this embodiment, the device 1100' is provided with securing means 5000 comprising two securing members 5001 provided one on each side of the mount assembly body 1150. The securing members 5001 are connected together by means of a handle 5002 and, when the handle is in a retracted position (FIGS. 12B and 12D), are located within respective bearings 5003, the end of each securing member 5001 being provided with a stop 5004 for engaging a recess 5005 in the end of the bearing 5003. When the mount assembly body 1150 of the device 1100' is located on a rail fastener housing (FIGS. 12D and 12E), the securing members 5001 are allowed to drop down under gravity (FIG. 12E) to lock behind a feature on the fastener housing, securing the device 1100' in position. Similar mechanisms may be used for other types of fastening.

Figure 13:
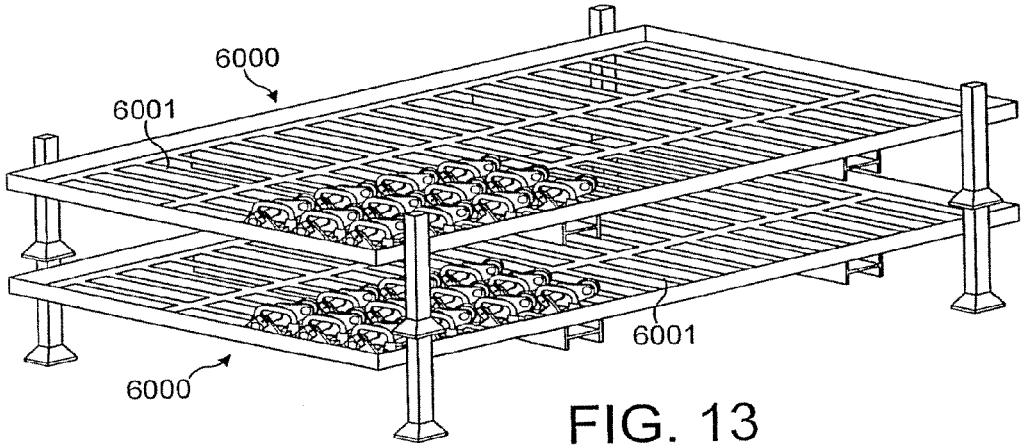
FIG. 13 shows pallets onto which embodiments of the present invention may be loaded for transportation.

FIG. 13 shows two tray-form pallets 6000, stacked one above the other, onto which a number of the devices 1100' have been loaded for transportation. The pallets 6000 are stackable, slingable and fork-liftable. Each pallet 6000 can hold up to 162 devices 1100', which self-lock onto the bars 6001 forming the floor of the pallet 6000. One of the pallet bars 6001 locates in an acute angle beneath the mount assembly body 1150 and another locates behind the extended securing member 5001. Thus, when the securing member 5001 is down, the device 1100' is locked onto the bars 6001 and cannot be removed. Additional bars 6001 are provided on the floor of the pallet 6000 to prevent the devices 1100' from tipping or falling through as they are loaded.

The invention claimed is:

1. A railway-rail-lifting device for lifting a railway rail, the railway rail having a head section supported by a web section, the head section having a first underside face and a second underside face, the first and second underside faces on opposite sides of the web section, the device comprising:

an arm;

a roller rotatably mounted to the arm, the arm being operable to be rotated to bring the roller to bear on a portion of the first underside face of the head section of the railway rail such that the roller exerts a lifting force on the portion of the first underside face; and a securing means operable to releasably secure the device in a fixed position to a rail fastening assembly;

wherein the device is arranged such that the device does not contact the second underside face during lifting of the rail.

2. A device as claimed in claim 1, wherein the arm is operable to be rotated such that the roller is brought into direct contact with the railway rail.

3. A device as claimed in claim 1, wherein the roller has an outer face having a width extending parallel to an axis of rotation of the roller, and wherein the roller is mounted such that said width is substantially parallel with the portion of the underside face when the roller is brought to bear on the underside face.

4. A device as claimed in claim 1, wherein the roller is mounted such that the axis of rotation is substantially perpendicular to a longitudinal axis of the railway rail when the roller is brought to bear on the railway rail.

5. A device as claimed in claim 1, wherein the roller is operable, when exerting a lifting force on the railway rail, to exert a position-maintaining force on the railway rail so as to resist a movement of the railway rail.

6. A device as claimed in claim 1, further comprising: a transmitting means operable to transmit a force to the arm so as to rotate the arm.

7. A device as claimed in claim 6, wherein the transmitting means comprises a shaft coupled to the arm.

8. A device as claimed in claim 7, wherein the transmitting means further comprises a handle or lever temporarily attachable to the shaft.

9. A device as claimed in claim 8, wherein the handle or lever is configured such that a force applied to the handle or lever by hand generates a lifting force.

10. A device as claimed in claim 1, wherein the securing means is operable to secure the device to a fastener housing portion of the rail fastening assembly.

11. A device as claimed in claim 10, wherein the securing means is operable to secure the device to the fastener housing portion such that a rail fastener may remain within the rail fastener housing portion.

12. A device as claimed in claim 1, wherein the roller comprises a bearing.

13. A device as claimed in claim 1, further comprising: a rotation limiting means operable to limit the rotation of the arm.

14. A device as claimed in claim 13, wherein the rotation limiting means comprises a member located across a path of rotation of the arm.

15. A device as claimed in claim 1, wherein the securing means comprises two securing members one securing member located on each side of a mount assembly body.

16. A railway-rail-lifting device for lifting a railway rail, the device comprising:

an arm;

a roller rotatably mounted to the arm, the arm being operable to be rotated to bring the roller to bear on the railway rail such that the roller exerts a lifting force on the railway rail; and a securing means operable to releasably secure the device in a fixed position to a rail fastening assembly;

wherein the securing means comprises two securing members, one securing member located on each side of a mount assembly body, and a handle connecting the two securing members to one another.

* * * * *